US005426818A

United States Patent [19]

Bushey

[11] Patent Number: 5,426,818

[45] Date of Patent: Jun. 27, 1995

[54] FURNITURE FLOOR GLIDE

[76] Inventor: Richard D. Bushey, 3521 16th Ave., Kenosha, Wis. 53140

[21] Appl. No.: 73,164

[22] Filed: Jun. 7, 1993

Related U.S. Application Data

[63] Continuation-in-part of Ser. No. 742,595, Aug. 9, 1991, Pat. No. 5,220,705.

[51] Int. Cl.[6] ..... A47B 91/06

[52] U.S. Cl. ..... 16/42 R

[58] Field of Search ..... 16/42 R

[56] References Cited

U.S. PATENT DOCUMENTS 1,982,138 11/1934 Herold ..... 16/42 R 3,326,508 6/1967 Boru ..... 16/42 R 5,081,740 1/1992 Smith ..... 16/42 R

*Primary Examiner*—P. Austin Bradley

*Assistant Examiner*—Chuck Y. Mah

*Attorney, Agent, or Firm*—John C. Shepard

[57] ABSTRACT

A floor glide for furniture and the like includes a concavo-convex disk having an arcuate convex lower surface, a concave upper surface defining a central cavity, a resilient pad fixed to the disk upper surface within the central cavity below the edge thereof, and adhesive means for securing the resilient pad to the bottom of furniture. The glide permits furniture to be moved easily along the surface of the floor.

10 Claims, 2 Drawing Sheets

FURNITURE FLOOR GLIDE

CROSS-REFERENCE TO RELATED APPLICATION

This application is a continuation-in-part of my U.S. patent application Ser. No. 07/742,595 filed Aug. 9, 1991, now U.S. Pat. No. 5,220,705.

BACKGROUND OF THE INVENTION

1. Technical Field

This invention relates generally to hardware and, more particularly, to a floor glide for furniture.

2. Background Art

In the prior art, coasters for furniture legs are quite common. Coasters are typically glass or rubber disks which are placed under the leg bottom. The coasters usually have a flat bottom so as to rest flat on the floor. The coasters act as a buffer between the legs, which are usually, small and sharp-edged, and the floor and distribute the weight of the leg over a larger area. As a result, the furniture does not scratch or mar the floor when the furniture is moved or leave depressions in the floor when furniture remains in one place over an extended period. However, the coasters found in the prior art do not permit furniture to be moved easily on carpet. The elimination of coasters from furniture legs situated on carpet does not make movement of furniture easier.

SUMMARY OF THE INVENTION

The present invention is directed to overcoming one or more of the problems as set forth above.

According to the present invention, a glide providing easier movement of furniture on carpeted and bare floors includes a concavo-convex sheet of material and an adhesive pad carried on the concave upper surface of the sheet within the cavity defined thereby.

In one exemplary embodiment of the invention, a glide includes a concavo-convex disk having an arcuate convex lower surface, a concave upper surface, a resilient pad fixed to the center portion of the sheet having adhesive for securing the pad to the furniture leg, whereby the furniture leg is placed on the adhesive pad and the convex surface has a curvature of such size to permit the disk to ride on the carpet surface so that the glide does not catch in the carpet pile.

An advantage of the invention is that the contact surface of the glide is smooth with no abrupt angles or edges to "dig" into the carpet or to "plow" when furniture is moved along the floor. The glide disperses the weight of the furniture piece over a large contact area thereby reducing the weight per square inch of contact. This combination of a relatively large, smooth, contoured contact surface reduces carpet wear and the force or thrust required to move furniture across carpet.

In one embodiment of the invention, the disk has a slick or low-friction coating on the floor-contacting bottom portion thereof.

Another advantage of the invention is that the glide can also be used with furniture placed on hard floors, such as wood, linoleum or a no-wax floor.

A further advantage of the invention is that since easy movement is facilitated, stress on furniture legs is minimized when horizontal pressure is applied.

Yet another advantage is that the glide will minimize permanent depressions or holes in the carpet or the underlying padding.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENTS

Best Modes for Carrying Out the Invention

Figure 4:
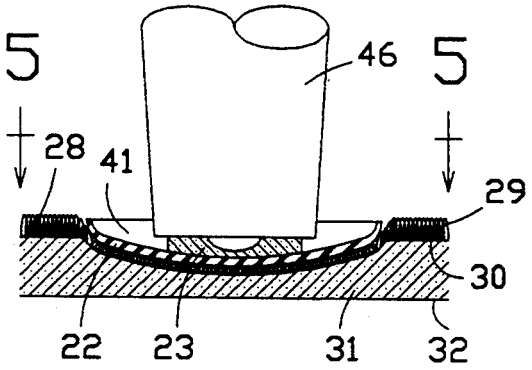
FIG. 4 is a cross-sectional view of the glide of FIG. 2 in use under a furniture leg on a carpeted floor.
Figure 5:
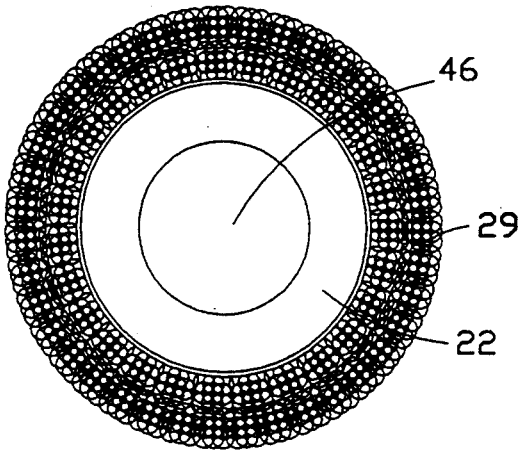
FIG. 5 is a horizontal cross-sectional view taken along line 5—5 of FIG. 4.
Figure 6:
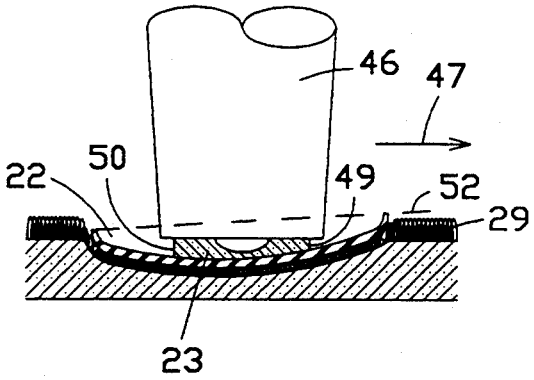
FIG. 6 is a view similar to FIG. 4, but showing the glide moving with the furniture leg along the carpeted floor.

Referring to FIG. 1 through 6 of the drawings, a glide, generally designated 20, is comprised of a concavo-convex sheet of material, such as disk 22, and a resilient adhesive pad 23. The glide 20 is used to support a furniture piece 25 on a floor. As shown in FIG. 4, the floor includes a carpet 28 with upraised pile 29 carried on a backing 30 overlying carpet padding 31 placed over the horizontal floor substrate 32.

The disk 22 has a convex lower surface 34, a concave upper surface 35, and a rim surface 36 defined between the peripheral edge 38 of the lower surface 34 and the surrounding outer edge 39 of the upper surface 35. Typically, the disk 22 is approximately 1 to 3 inches in diameter, ¼ to ½ inches high, and defines a concave depression, or central cavity 41, approximately 3/16 to 7/16 inch deep, which has an oval or elliptical vertical cross section. The rim surface 36 faces upwardly and lies in a generally horizontal plane.

The disk 22 is integrally formed or molded from thermoplastic or other suitable material and may also be injection molded or pressure formed. Co-polyester, high-density, ultrahigh density and high molecular weight polyethylene, and Teflon R have been found to be very suitable in enabling ease of movement and for use on a variety of floor types. Materials that are fairly soft and resilient so that the possibility of cracking or breakage is minimized are preferable. High molecular weight polyethylene and PETG co-polyester have been found suitable in this respect. The initial flat thickness of the disk material is 0.080 inches for disks larger than 2 inches in diameter and 0.060 inches for disks smaller than two inches in diameter. This thickness is maintained at the center of the disk during forming, but because of stretching at the edges this thickness may reduced by approximately 40 percent so that the disk edge might be substantially thinner than the disk bottom.

The resilient pad 23 is carried on the upper surface 35 within the cavity 41. The pad 23 includes a main body portion 43, which is fixed, as by adhesive (not shown) to the disk upper surface 35, and has a layer of adhesive (not numbered) on its top surface 44. The body portion 43 may be made of one or more layers of any resilient type material, including plastic foam, felt or rubber or layers of such materials. The pad may be attached to the disk by any suitable means, such as glue or adhesive. As shown herein, the pad 23 is approximately 1 to 2 inches in diameter and is $\frac{1}{8}$ to $\frac{1}{4}$ inch thick so that its top surface 44 lies below the outer edge 39 of the disk 22. In a typical embodiment, the center pad is made of cross-linked polyethylene foam which is approximately $\frac{1}{8}$ to $\frac{1}{4}$ inch thick and has a density of approximately 3 lb./ft.$^3$ and has adhesive applied to both flat sides. Typical pad diameters would be $1\frac{1}{4}$ inches for disks $2\frac{1}{4}$ or $2\frac{3}{4}$ inches in diameter and 7/8 inch for disks $1\frac{1}{4}$ or $1\frac{3}{4}$ inches in diameter.

The center portion of the disk 22 where the pad 23 is attached may be roughened to provide a non-smooth surface for the adhesive to grip. Usually, this roughening would take place after molding or forming so that the roughening is not transferred through the disk material during shaping to the smooth lower outside bottom surface 34 of the disk. Prior to use, the adhesive on the upper side of the pad may be covered by a removable plastic or waxed backing paper (not shown), which is be peeled away from the pad 23 prior to application.

Figure 1:
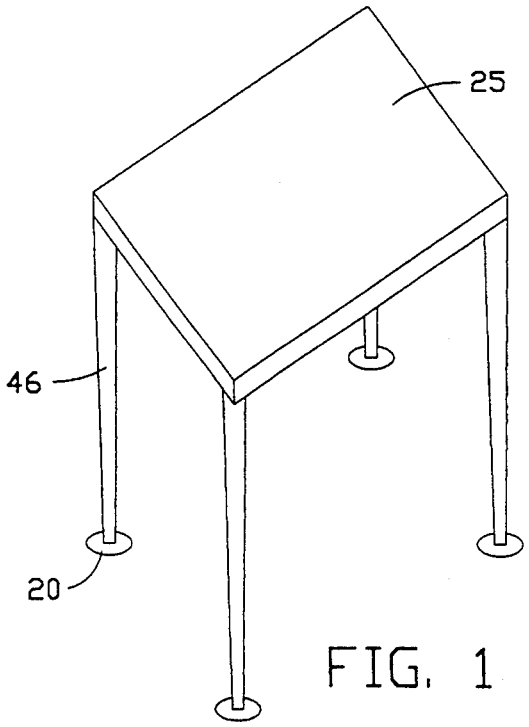
FIG. 1 is a perspective view of a table employing glides constructed in accordance with the present invention.

In use, the glide 20 is attached to the bottom of a furniture leg 46 as seen in FIGS. 1 and 4. Note that the furniture piece 25 does not have to be turned over to install the glide 20. Each furniture leg 46 in turn is simply lifted slightly and the glide 20 is placed under the leg 46 with the adhesive exposed to the leg bottom. When the pad 23 contacts the leg bottom as the leg 46 is lowered, the adhesive bonds the glide 20 to the leg 46. The weight of the furniture piece 25 on the adhesive makes the bond permanent.

The low center of gravity, which is provided by the concavo-convex configuration at the point of contact with the furniture leg 46, cradles the point of contact by placing the shear pressure point above the bonding location. The low center of gravity and the resilient pad 23 help to maintain total contact between the bottom of the furniture leg 46 and adhesive pad 23. When the furniture 25 and glide 20 are moved along the carpet 28 in the direction indicated by the arrow 47 in FIG. 6, the leading curve of the glide 20 bends the pile 29 forward and downwardly from the base of the pile 29. The glide 20 then climbs the pile 29 with the leading edge 49 of the resilient pad 23 being compressed between the lead edge of the leg 46 and the disk 22 and the trailing edge 50 of the pad 23 being permitted to uncompress or expand. This causes the glide 20 to tilt slightly when the furniture piece 25 is moved, thereby creating a natural inclined plane as indicated by dashed line 52. As a result, a mechanical advantage is achieved permitting the glide to ride above the carpet surface. The carpet pile 29 which exits from behind the glide 20 will remain bent over until the glide 20 clears the top end of the pile 29 at which time the pile 29 will snap back up.

The glide disk provides a smooth, continuously arcuate surface and the pad provides a flexible joint thus enabling the glide to travel easily along smooth floors, carpeted floors, or uneven floors. A smaller radius edge 48 is formed to provide rigidity so that the disk does not substantially deform during travel and present a sharp or blunt edge. The glide edge is curved upwardly so that the glide does not dig into the carpet when the carpet fiber hits the glide edge. Rather, the carpet fibers bend along this small radius so that the glide rides over the carpet. In the case of a $2\frac{3}{4}$ inch diameter disk, the arcuate surface 34 is approximately defined by a 4—inch internal radius and the small radius edge 48 by a 5/32—inch internal radius. By adjusting the small radius arc, a draft angle of 7° may be maintained at the peripheral edge so that disk will release easily from a mold.

Depending on the particular use to which the glide 20 will be put, the size, shape and color of the glide 20 may vary. The sizes and shapes described herein are exemplary of those that might be used with typical tables and chairs.

Figure 7:
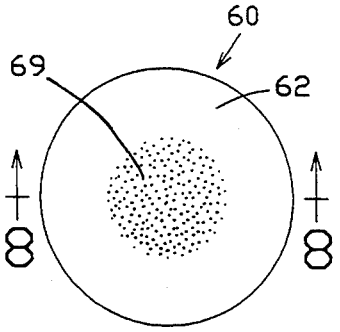
FIG. 7 is a bottom view of a second embodiment of a glide constructed in accordance with the invention having a low-friction coating on the bottom thereof.
Figure 8:
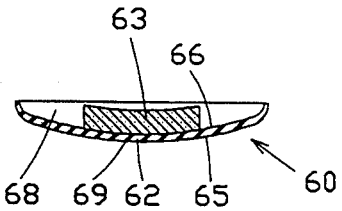
FIG. 8 is a vertical cross-sectional view taken along line 8—8 of FIG. 7.

In FIGS. 7 and 8, a second embodiment is shown. Herein, the glide, generally designated 60, includes a disk 62 and a resilient pad 63. The disk 62 has a convex lower surface 65 and a concave upper surface 66 defining a central cavity 68. A slick or low friction coating 69 is carried by the lower surface 65. This coating may be produced by application of a low-friction Teflon or similar material such as Poly-TFE marketed under the name Fluoroglide FB Film Bonding Grade Dry Film Lubricant and Anti-Stick Agent manufactured by Norton Performance Plastics Corporation of Wayne, N.J., or Vydox AR/IPA Fluorotelomer Dispersion manufactured by DuPont Chemicals of Wilmington, Del., or some other similar material having suitable low-friction, glide characteristics.

Figure 9:
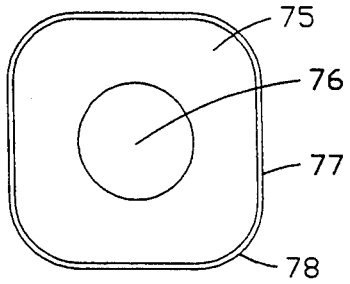
FIG. 9 is a top elevational view of a third embodiment of a glide constructed in accordance with the present invention.
Figure 2:
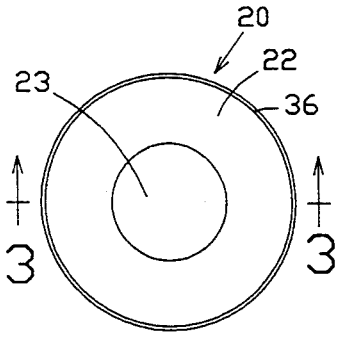
FIG. 2 is a top elevational view of a first embodiment of a glide constructed in accordance with the present invention.
Figure 10:
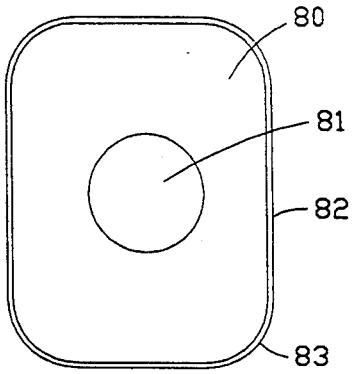
FIG. 10 is a top elevational view of a fourth embodiment of a glide constructed in accordance with the present invention; and, FIG. 11 is a cross-sectional view of a furniture leg resting directly on a carpeted floor without a glide.
Figure 3:
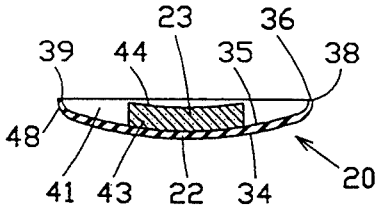
FIG. 3 is a vertical cross-sectional view taken along line 3—3 of FIG. 2.

Note that the disk need not have a circular shape. In FIG. 9, a concavo-convex glide 75, similar in construction to the glide 20, has a resilient adhesive pad 76 and a square configuration with straight sides 77 and rounded corners 78. In FIG. 10, a concavo-convex glide 80, similar to the glide 60, has a resilient adhesive pad 81 and a rectangular configuration with straight sides 82 and rounded corners 83.

While the sizes and dimensions given above are typical, the actual size of the glide will be determined by the weight of the furniture piece and the dimension and shape of its leg, i.e., larger glides will be used with larger furniture pieces. If the leg is round, the glide might be round; if the leg is square, the glide might be square. In FIGS. 1 and 8, the glide is circular; in FIG. 9, the glide is square with rounded corners; and, in FIG. 10, the glide is rectangular with rounded corners.

Thus, the glide may have a horizontal configuration which is rounded, i.e., circular or oval, or which is box-shaped, i.e., square or rectangular, or any other suitable configuration. Similarly, the pad may be round, oval, square or rectangular, although it has been found that rounded pads will minimize peeling of the adhesive from the disk and the furniture. The glide can be clear or colored. If the user wants a high degree of obscurity, the glide will be made of clear plastic to render the glide transparent. Likewise, on a brown floor, the glide might be brown so that the glide is not easily seen.

Figure 11:
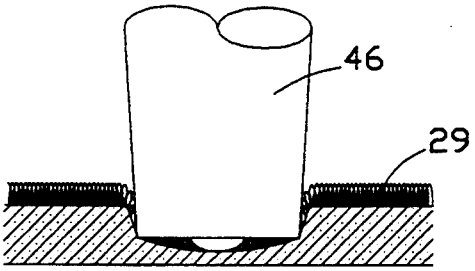

In FIG. 11, the furniture leg 46 rests directly on the carpet and digs a hole in the carpet. Because of the sharp edge presented at the bottom of the furniture leg, the furniture must be lifted if it is to be moved since it cannot be moved horizontally directly. With the use of the glide, no such deep hole is made, because the weight of the furniture is distributed over a greater area thereby reducing pressure placed on the carpet. With the smooth surface, the inclined plane and the reduced pressure, the furniture 25 can be moved easily along the carpet 28 without plowing. And at rest, the furniture 25 will not dig into the carpet 28, since the carpet 28 is not crushed straight downward, but simply bent over with less pressure when the furniture 25 is slid horizontally into position. Consequently, the carpet pile 29 is less likely to be left with a deep, permanent depression.

Industrial Applicability

From the foregoing, it should be apparent that the glides described herein are simple and inexpensive and provide a convenient and effective means for moving and locating furniture on flooring, such as carpet.

Other aspects, objects and advantages of this invention can be obtained from a study of the drawings, the disclosure and the appended claims.

What is claimed is:

1. A glide for supporting furniture on a substantially horizontal floor surface comprising:

a relatively rigid concavo-convex disk having an arcuate convex lower surface with a peripheral edge and a concave upper surface defining a central cavity with a surrounding outer edge, said disk lower surface being defined by a large radius segment along the bottom portion thereof having a radius less than 5 inches and by a relatively small radius segment adjacent said peripheral edge having a radius between $\frac{1}{8}$ and $\frac{1}{2}$ inch, said disk having an external diameter between 1 and 3 inches, a height between $\frac{1}{4}$ and $\frac{1}{2}$ inch and a wall thickness between 0.05 and 0.1 inch, a resilient pad having a bottom surface fixed by adhesive to the disk upper surface within said central cavity and having a top surface facing upwardly, adhesive means carried by said pad top surface for securing said resilient pad to the bottom of furniture, and backing material carried by said pad top surface manually removable prior to application to furniture to expose said adhesive means to the furniture bottom, whereby the glide is positioned between the supported furniture and the floor with said lower surface riding on the floor surface so that the glide moves easily along the floor.

2. The glide of claim 1 wherein the lower surface of said disk at said peripheral edge is slanted slightly from a line perpendicular to horizontal to provide a small draft angle of approximately 7 degrees.

3. The glide of claim 1 wherein said disk is formed from one of high molecular weight polyethylene and co-polyester PETG.

4. The glide of claim 1 wherein said pad is formed from one of foam and felt.

5. The glide of claim 1 wherein said resilient pad has a diameter and a height less that that of said central cavity so as to lie completely within said central cavity vertically below the outer edge of said central cavity and horizontally spaced from the peripheral edge of said central cavity.

6. The glide of claim 1 wherein at least a portion of said lower surface of said disk carries a low-friction coating.

7. A glide for supporting furniture on a substantially horizontal floor surface comprising:

a relatively rigid concavo-convex disk of substantially uniform thickness along the bottom thereof, said disk having an convex lower surface with a peripheral edge and a concave upper surface defining a central cavity with a surrounding outer edge, said lower surface being continuously arcuate over its entire extent, said lower surface being defined by a large radius segment along the bottom portion thereof having a radius less than 5 inches and a smaller radius segment adjacent said peripheral edge, said disk having an external diameter between 1 and 3 inches, a height between $\frac{1}{4}$ and $\frac{1}{2}$ inch and a wall thickness between 0.05 and 0.1 inch, said lower surface being slanted slightly from a line perpendicular to horizontal to provide a small draft angle, a resilient pad having a bottom surface fixed by adhesive to said disk upper surface and a top surface facing upwardly, said resilient pad having a diameter and a height less than said central cavity so as to lie completely within said central cavity vertically below the outer edge of said central cavity and horizontally spaced from the peripheral edge of said central cavity, a low-friction coating carried on at least a portion of said lower surface of said disk, adhesive means carried by said top surface for securing said resilient pad to the bottom of furniture, and backing material carried by said pad top surface manually removable prior to application to furniture to expose said adhesive means to the furniture bottom, whereby the glide is positioned between the supported furniture and the floor with the lower surface of the glide sliding along the surface of the floor to facilitate movement of the furniture along the floor.

8. The glide of claim 7 wherein said smaller radius segment has a radius between $\frac{1}{8}$ and $\frac{1}{2}$ inch.

9. The glide of claim 7 wherein said draft angle is approximately 7 degrees.

10. A glide for supporting furniture on a substantially horizontal floor surface comprising:

a relatively rigid concavo-convex disk formed from one of high molecular weight polyethylene and PETG co-polyester and having an arcuate convex lower surface with a peripheral edge and a concave upper surface defining a central cavity with a surrounding outer edge, said disk lower surface being defined by a large radius segment along the bottom portion thereof having a radius less than 5 inches and by a relatively small radius segment adjacent said peripheral edge having a radius between $\frac{1}{8}$ and $\frac{1}{2}$ inch, said disk having an external diameter between 1 and 3 inches, a height between $\frac{1}{4}$ and $\frac{1}{2}$ inch and a wall thickness between 0.05 and 0.1 inch, said lower surface of said disk at said peripheral edge being slanted slightly from a line perpendicular to horizontal to provide a small draft angle of approximately 7 degrees, said peripheral edge of said lower surface and said outer edge of said upper surface defining a rim therebetween, a resilient pad formed of one of foam and felt and having a bottom surface fixed by adhesive to the disk upper surface within said central cavity and having a top surface facing upwardly, said resilient pad having a diameter and a height less than said central cavity so as to lie completely within said central cavity vertically below the outer edge of said central cavity and horizontally spaced from the peripheral edge of said central cavity, adhesive means carried by said pad top surface for securing said resilient pad to the bottom of furniture, and backing material carried by said pad top surface manually removable prior to application to furniture to expose said adhesive means to the furniture bottom, whereby the glide is positioned between the supported furniture and the floor with said lower surface riding on the floor surface so that the glide moves easily along the floor.

* * * * *